United States Patent [19]

Simms

[11] 4,191,162

[45] Mar. 4, 1980

[54] ENERGY SAVING AIR-FLOW HEATER

[76] Inventor: Donald S. Simms, Brattleboro Rd., Box 355, Rte. 1, Leyden, Mass. 01301

[21] Appl. No.: 854,414

[22] Filed: Nov. 23, 1977

[51] Int. Cl.[2] ..... F24B 5/02

[52] U.S. Cl. ..... 126/123; 126/121

[58] Field of Search ..... 126/121, 123, 126, 140, 126/131, 295, 200, 202; 237/51

[56] References Cited

U.S. PATENT DOCUMENTS

| | | | |
|---|---|---|---|
| 637,805 | 11/1899 | Lev | 126/200 |
| 1,255,493 | 2/1918 | Williams | 126/123 |
| 1,316,631 | 9/1919 | Monihan | 126/200 X |
| 1,546,503 | 7/1925 | Meier | 126/126 |
| 2,743,720 | 5/1956 | Dollinger | 126/121 |
| 3,388,698 | 6/1968 | Satkunas | 126/200 |

FOREIGN PATENT DOCUMENTS

| | | | |
|---|---|---|---|
| 1004182 | 3/1952 | France | 126/121 |
| 7431 | of 1915 | United Kingdom | 126/295 |
| 532680 | 1/1941 | United Kingdom | 126/121 |

*Primary Examiner*—Lloyd L. King
*Assistant Examiner*—Harold Joyce
*Attorney, Agent, or Firm*—Leonard S. Michelman

[57] ABSTRACT

The within invention comprises a stove unit or fire box to be used to heat the inside of buildings. It is particularly designed to be used inside the hearth of fireplaces. It has slots and openings in its panel flanges for permitting the panels to be adjusted so as to change the locations of the panels to cover the area in the front of the fireplace both on the sides and top of the stove unit so that only the glass doors of the combustion chamber or fire box will be seen and the inside of the fireplace cavity will be hidden from view. The panels, and the location of the slots and openings are so arranged and are of such dimension to permit the unit to fit most sizes of fireplaces.

The unit also has an air intake duct which converts the cool air, heats it and jets it out into the area to be heated. The air intake system is designed by reducing the cross-section of the air intake duct causing an increase in the velocity of the warm air that is transmitted from the unit, eliminating the need for a blower, and saving the use of electricity.

The cool air is drawn in from openings located at floor level at the bottom of the unit and travels through an outer sleeve around the fire box whereby it is heated. It then exits from the top of the unit to heat the room.

The unit can be set up by the use of a screw driver and the most unskilled mechanic can change the positions of the panels to conceal the unused portion of the fireplace cavity.

2 Claims, 18 Drawing Figures

Fig-11
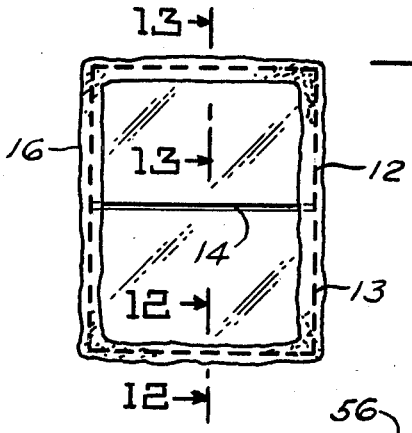
Fig-12
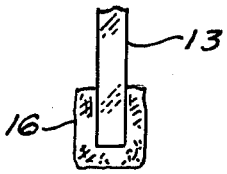
Fig-13
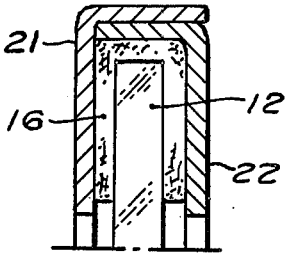
Fig-14
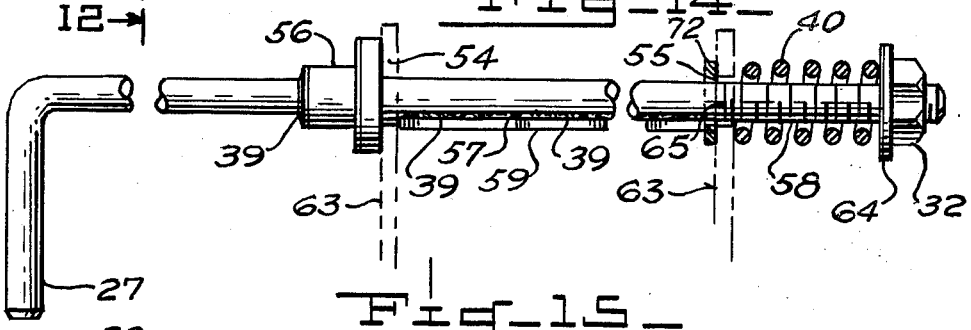
Fig-15
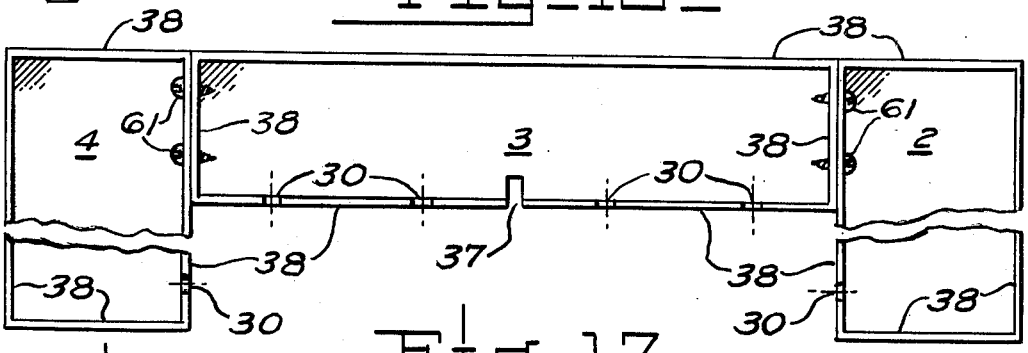
Fig-16
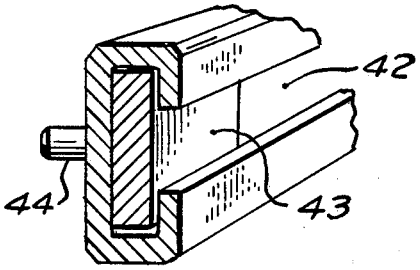
Fig-17
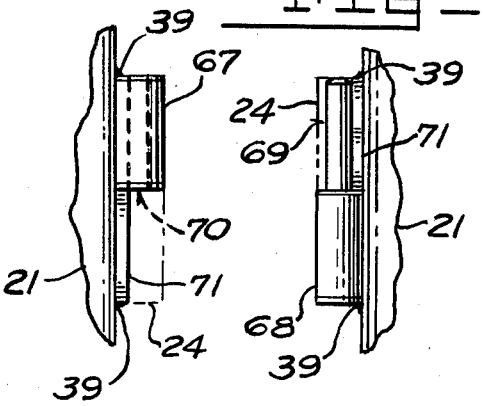
Fig-18

ENERGY SAVING AIR-FLOW HEATER

The within invention is concerned with an enclosure unit for containing wood burning logs and the like adapted to be located within the opening of the fireplace, the unit having adjustable means for adapting it to fireplaces of various sizes, and whereby the front of the unit appears to be perfectly fitted within the said fireplace opening. In addition thereto, the unit is designed to create a flow of warm air from the fireplace into the room in which it is located.

Because of the world wide energy shortage and the increase in the cost of fuel, there is a need for a device such as herein described so as to conserve energy and permit the consumer to save on his heating costs. The unit provides a method of preserving energy, particularly in the winter months.

Many people have been returning to the use of the fireplace, and are burning wood and other similar flammable materials in order to maintain a lower cost to the heating of their homes and other facilities.

As the result of this, there have been many attempts to provide a unit that will increase the efficiency of the heat developed by the wood or carbon burning material; and, in addition thereto, many attempts have been made to prevent sparks and fire from igniting into the areas where the fire is taking place, as well as eliminating bad aromas from the gases created by the fire.

The devices that have been designed to perform the above functions have failed to meet the problems in the field, and have left the consumer with dissatisfaction.

It is a principal object of the within invention to provide a fireplace unit which will fit into the opening of almost any size of fireplace, with the ability to connect the flue and damper circuit of the unit into the fireplace chimney, and also to provide an outer appearance of a perfect fit of the unit into the fireplace, irrespective of the size of the fireplace.

It is a further object of the within invention to provide a fireplace enclosure unit which has specially designed glass doors that are artistic, but yet functional and provide safety and which fit in the front of the fireplace in such a manner as to permit the fireplace to be used without concern as to the safety of the breaking of the glass.

It is still another object of the within invention to provide a heating system in the unit wherein air is drawn from the floor of the room which is usually the coldest air in the room, and the air is caused to flow into the unit above the fire where it is heated, and because of the novel design of the air ducts in the unit, it is blown out with velocity into the room to maintain the air in the room warm and to maintain an efficient cycle.

It is another object of the invention to provide a novel means for drawing cool air into the unit, converting same to heated air and then generating a jet stream of warm air that exits from the unit into the area to be heated.

A yet further object of the invention is to provide a fireplace unit that is prefabricated, can be easily assembled by the consumer, simply inserted into the fireplace opening, and set up for immediate operation.

It is a further and additional object of the within invention to provide an apparatus to be used with a fireplace that is simple in construction, inexpensive in the cost of manufacture and which performs the function of providing efficient heat, as well as safety from accidental fire.

For a better understanding of this invention and the objects which have been hereinbefore mentioned, reference is made to the accompanying drawings in which:

FIG. 11 is a front elevational view of one door of the unit showing the details of its construction.

FIG. 12 is a cross-section view of the door of FIG. 11 along line 12—12.

FIG. 13 is a partial sectional view, taken along line 13—13 of FIG. 11.

FIG. 14 is a side elevational view of the damper control assembly.

FIG. 15 is a front elevational view, in exploded form, of the panel assembly which adapts the unit to fit different size fireplaces.

FIG. 16 is a sectional view, in perspective, showing the details of construction of the combustion control assembly.

FIG. 17 is a side elevational view of the hinge mounted upon the glass door frame.

FIG. 18 is a side elevational view of the hinge pin mounting assembly which is adapted to receive the hinge shown in FIG. 17.

Figure 1:
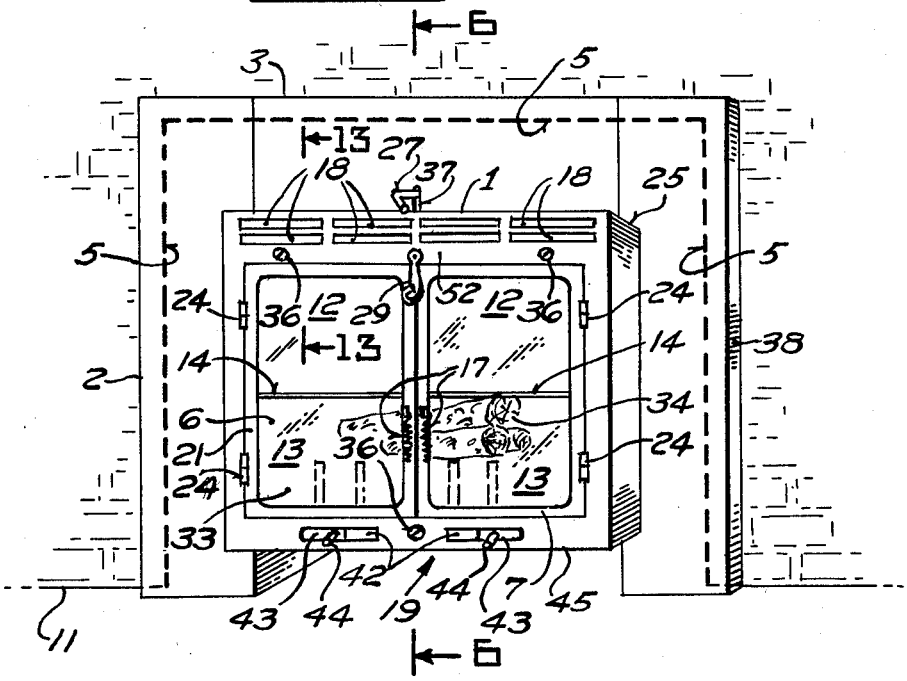
FIG. 1 is a front elevational view of the fireplace unit mounted within a fireplace opening.

Unit 1 may be hereinafter referred to as a fireplace enclosure unit 1, fire box 1, stove 1, or as a wood burning heater 1, or as an appliance 1, or as a heat generator 1. The use of these words interchangeably refer to numeral 1 which is, indeed, the entire assembly of the unit within the fireplace.

Unit 1 comprises of a left panel 2, a top panel 3, and a right panel 4. These panels are flat and made of metal and, as hereinafter to be described, are adaptable to various sizes and positions. These panels 2, 3, and 4 are more particularly shown in the view of FIG. 15.

The Unit 1 also has mounted, in front of the material to be burned, a left glass door 6 and a right glass door 7.

Inside the Unit 1 (see FIG. 6) is a U-shaped baffle assembly comprising of a rear baffle 8 with at right angles secured by welds at 39 the left baffle 10 and the right baffle 8. The baffles are made of a heavy steel construction. They give mass to the unit and act as a protecting device against the heat intensity which is generated by the fire on the inside of the unit. This arrangement holds the heat so that more heat will be generated for a longer period of time to the air that passes through the unit.

Reference is made to FIG. 1 in which can be seen next to the panels 3, 4, and 2, the wall of the fireplace which, in the usual conventional manner, is made of brick 11. There are separate panes of glass 12 and 13 shown in the doors 6 and 7. These separate panes 12 and 13 can be seen clearly in the view of FIG. 11.

Figure 5:
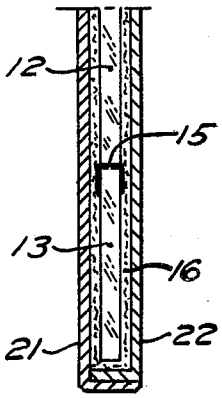
FIG. 5 is a side elevational view in cross section of the glass mounted within the frame of the door shown along line 5—5 of FIG. 2.

The glass 12 and 13 is a special type of high temperature borosilicate annealed glass. This type of glass is much longer enduring and requires less maintenance since the glass, being annealed, does not have to return from the chemical state of being tempered and then annealed. There appears a line 14 and particularly in FIG. 3, which is a separation of the two panes of glass in the same door. Reference is also made to the view of FIG. 11 where this line 14 is also shown. This line 14 is a space 8 to 10 thousandths of an inch separating the glass. Inside the frame at 21 there is mounted a sheet of asbestos insulation 15. The asbestos insulation 15 does not appear where the glass 12 and 13 join, but is hidden from view in the frame. The asbestos insulation 15 prevents the two panes of glass 12 and 13 from making contact with one another and provides room for expansion of the glass panes from the heat. Reference is made to the view of FIG. 5 which shows how asbestos 15 creates the space 14 which allows for the expansion. There is asbestos insulation 16 between the outside frame 21 and the glass 12 and 13 and the inside frame 22 which is shown in the view of FIG. 11 and also in the cross-section view of FIG. 5 circumscribing the glass where it contacts the metal frame particularly the outside frame 21 and the inside frame 22 of the door.

There is a tinnerman clip 23 (shown clearly in the perspective view of FIG. 9) which attaches the outside door frame 21 with the inside door frame 22. These clips 23 make it a simple matter to remove the two separate portions of the door frame to replace any glass if the need arise. The tinnerman clip 23 as a connector permits expansion and contraction without damage to the glass caused by the intensity of the heat generated during the operation of the unit 1.

The doors are mounted on hinges which are shown in diagrammatic details in the view of FIG. 17 and 18.

The outside door frame 21 has mounted thereupon by a weld at 39 a female hinge member 67 which has mounted therein, a pin hole 70. Member 67 is secured to a hinge mounting plate 71. There are four separate hinge assemblies for the door.

The mate or male member of the hinge assembly is the pin 69, which is inserted into the opening 70 in member 67, and includes the hinge heavy pin 24, the weld 39 at the top which secures the components together, the outside door frame 21, the bottom half of the hinge 68 support member and the weld 39 at the bottom thereof. The assembly can be seen mounted in the various views, particularly in the views of FIGS. 1, 2, and 3, and is designated by the numeral 24.

Figures 6, 7, 8, 9, 10:
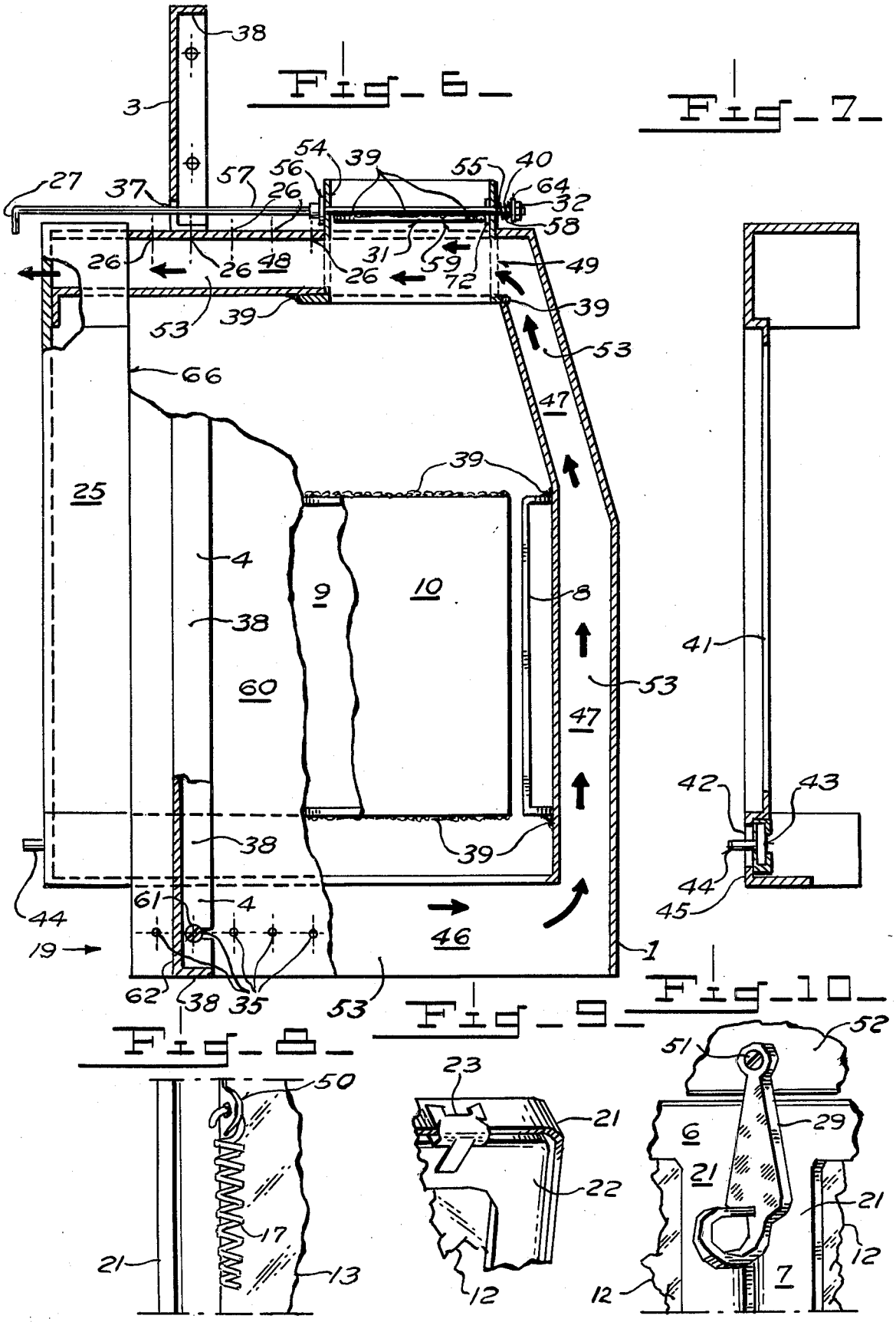
FIG. 6 is a side elevational view of FIG. 1 taken along line 6—6 of FIG. 1.
FIG. 7 is a sectional view of a portion of the unit taken along line 7—7 of FIG. 2, showing the construction of the facade assembly.
FIG. 8 is an exploded front view of the door handles.
FIG. 9 is an exploded view, in perspective showing how the sections of the glass door frames are secured by means of a tinnerman clip.
FIG. 10 is a front view, in perspective, showing the locking lever which maintains the glass doors of the unit in a closed and locked position.

Mounted near the outside frame 21 is a wire handle 17 which can be seen in the view of FIG. 8. The wire handle 17 is in the shape of a helical spring and is connected by a hook to the stove door handle flange 50. The spring design of the handle 17 maintains the handle 17 in a cooler state than would be if it were solid.

Figure 2:
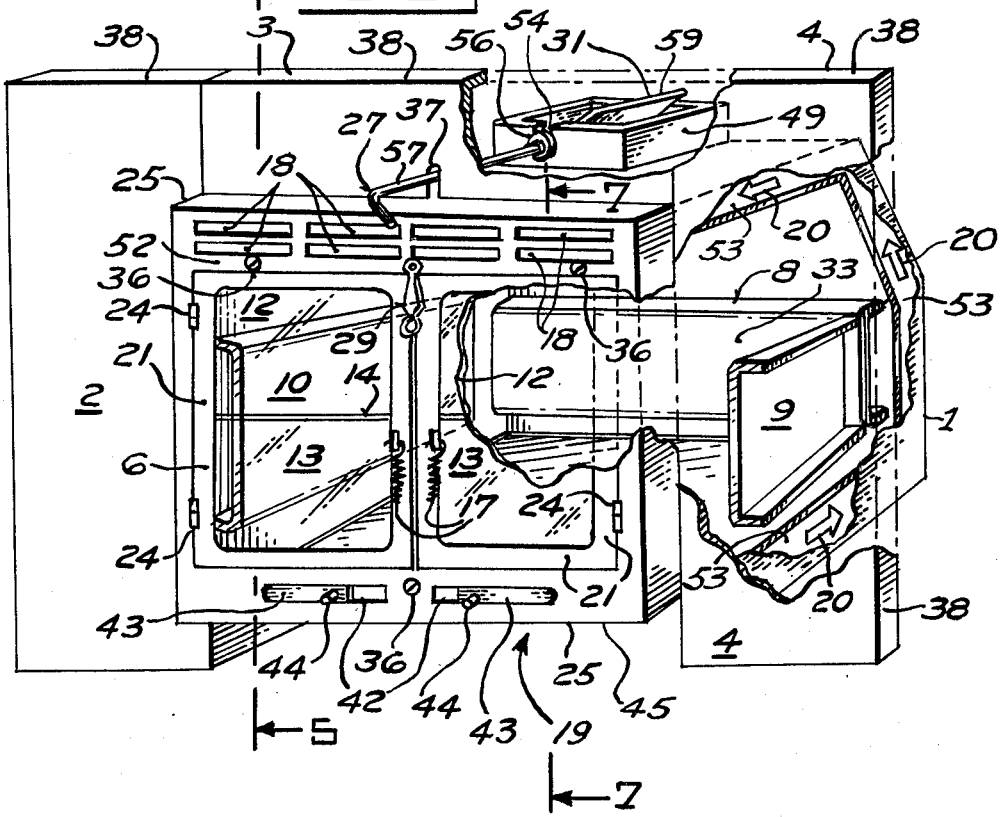
FIG. 2 is a perspective view of FIG. 1 showing in diagrammatic form various details of the components of the fireplace unit.

In the front view of FIG. 2 particularly, can be seen the air flow exits 18. In FIG. 6, the arrows show the flow of the air from the air opening exits 18. The air that exits from 18 has to enter the unit 1. It does so at 19.

Figure 3:
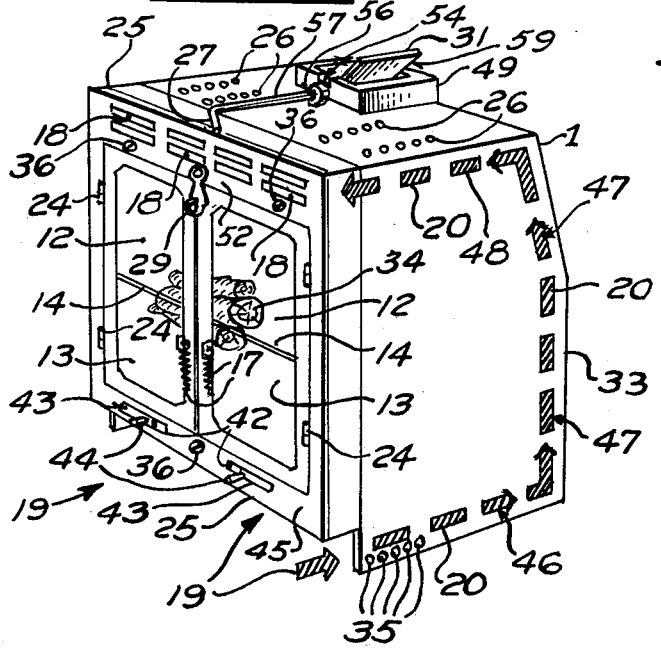
FIG. 3 is a perspective view of FIG. 1 emphasizing one of the sides of the unit and showing in diagrammatic form various details of the air flow.

The air flow is shown by the arrow 20 in the view of FIGS. 2, 3 and 6.

The circulation chamber 53 comprises of many components to make up the ability of the unit to draw in cold air, heat it, and exit it so that it will be warm and heat the room or the area to be heated.

The air enters the intake chamber at 19 which is below the facade assembly 25. It is located at the bottom of the unit 1. It enters between the floor of the area where the unit 1 is mounted. It follows the path of the arrow 20 and goes around the outside of the heating assembly and the baffles 8, 9, and 10 and can be seen by following the arrows on the right hand side of FIG. 6 wherein the number 53 representing the circulation chamber and the number 20 representing the flow of the air continue to reappear as one observes the arrows going counter clockwise up towards the top of FIG. 6 and then around towards the front of FIG. 6. This can also be seen in the view of FIG. 2. The area at 48 is approximately two inches wide as is the area at 47. However, the area at 46 is three inches wide. The reason that the area is widest where it enters and narrower where it exits is because as the air is heated it expands and since the molecules of the air also expand from the heat. This creates both a vacuum in the larger areas at 46 and 47 and also creates an increase in velocity of the flow of the air. This is an application of the theory of Bernoulli's principle where a reduction in the cross-section of a conductor under the same pressure going through the conductor increases the speed through the smaller or restricted area.

The flow of the air is increased because of this convection.

This eliminates the need for an auxiliary blower although it is contemplated that a low current electric fan could be used with this system. However, in operation, it has been found that this unit will heat a five room house and a fan has not been necessary in the ordinary circumstances.

There is, located below the doors in the views of FIGS. 1, 2, 3 and 6, as assembly 25 which is hereinafter referred to as the facade assembly 25. The facade assembly 25 comprises of the combustion control slot 42 and the slide shutter 43 which is a component of the combustion control assembly. There is a knob 44 for sliding the shutter 43 in the slot 42. Reference is made to the view of FIG. 7, which shows a bent recession 41 for the door seal on the lower front frame 45. It is to be noted that the air, necessary to cause the fire to burn, enters through the facade assembly 25. The shutter 43 is moveable within the slots 42. The knob 44 being connected to the shutter 43 controls the amount of air entering the slots 42. Therefore, the air to feed the fire will be increased or decreased by the movement of the slide knob 44. The intensity of fire is so controlled, since if the fire does not receive much oxygen, it will not burn as rapidly as in the instance of the slots 42 being closed by the shutter 43.

There is a damper assembly (see FIG. 4) which comprises of a slot 54 in the neck of the unit 1, an opening in the neck 55, a collar or damper control rod 56, a rod 57 which may be referred to as a damper control rod, a threaded portion of the rod 58, a flapper 59, which does the damping, a plate 60 (FIG. 6) on the right side of the fire box and a sheet metal screw 61.

Figure 4:
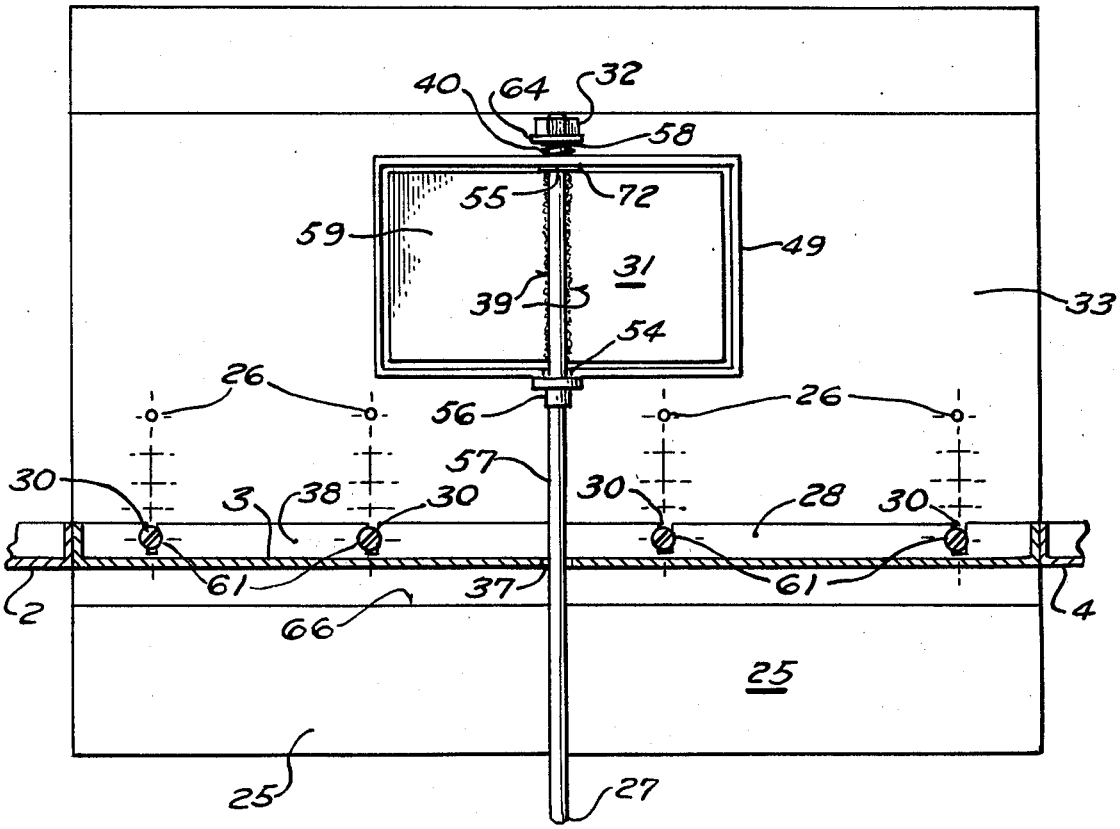
FIG. 4 is a top elevational view looking down on the view of FIG. 1 showing in particular detail the damper and exhaust components of the unit.

The arrangement of these components can be seen in views of FIGS. 4 and 6 more clearly than in the views of FIGS. 1, 2, and 3.

For other details reference is made to the view of FIG. 14. The control damper handle 27 is L-shaped, has a weld 39 securing it to the collar 56. Rod 27 passes through an opening 54 in the neck of the unit 1 in the phantom 63. There is another weld at 39 which secures the flapper or damper control plate 59 to the rod 27. The control damper rod spring 40 circumscribes the threaded portion of the rod 58 and is locked in a position by the control damper rod nut 32 abutting its washer 64. Rod 27 also passes through the opening 55 in the unit 1 at 63. The threaded portion of the control rod 27 is located to the right of opening 55, FIG. 14.

In the view of FIG. 6, near the bottom thereof, in the area at 19 wherein the air enters, are located the sheet metal screws 61 which lock the slot 5 in the flange 38 into the openings 35. This structure is the same on all three sides of the panels 2, 3, and 4. It is to be noted that there are five openings 35 in each of the panels 2, 3, and 4 to be spaced at different intervals. The position of the panels are therefore adjustable and permit the unit 1 to be mounted into a fireplace so that the unit 1 itself is adaptable to fit fireplaces of most any size. The sheet metal screw 61 can be removed. The entire panel 2, 3, or 4 can be positioned so as to have the opening 35 for the screws located aligned with any one of the other openings 35. It is to be noted that the slots are in the panel wherein the sheet metal screws 61 are inserted. The openings 35 are in the side walls of the fire box unit and are aligned with each other on both sides so that the panel will always be in the same plane and will not appear to be out of alignment with the walls of the fireplace. A similar arrangement is in the panel 3 at the top of the unit 1. There are openings 35 in the flange of top panel 3. This arrangement permits the top panel 3 to be positioned with the side panels. Reference is made to the view of FIG. 15 in which the various panels are shown.

The right panel 4 and the left panel 2 have similar construction as at 62 in the view of FIG. 6.

There is a flange 38 on all four sides of two, three and four inches arranged five-eighths of an inch wide. There is a slot 30 in the lower flange of the top panel 3. The slots 30 appear at intervals in the panel 3. The slot 37 is for the damper control rod. The sheet metal screws 61 are also shown interconnecting the top panel 3 with the side panels 2 and 4, through the flanges 38.

The fire box 33 has logs 34 mounted therein.

In the view of FIG. 4, there are five openings 26 in the top of the unit. These openings 26 are similar to the openings 35 in the side of the unit. They are aligned, as previously stated, through the openings 35 so that when the top panel 3 is moved forwardly or backwardly on the top of the unit 1, the side panels 4 and 2 respectively will thus align with the same positioned openings in the side of the unit so that all panels 2, 3, and 4 will remain in the same plane. The entire assembly 28 is in the view of FIG. 4. Assembly 28 may be hereinafter referred to as the fastening assembly 28.

Reference is now made to the view of FIG. 10 in which there is a lever arm 29 which closes the front doors of the unit. The arm 29 is mounted by a pivot pin 51. The pin 51 is mounted within the upper front frame of the facade 52. The left door 6 and the right door 7 are prevented from opening when the lever arm 29 is in position as shown in the view of FIG. 10. The outside door frame 21 and the glass 12 are shown in the view of FIG. 10 in order to orient and make for a better understanding of the location of the arm 29 that opens and closes the doors 6 and 7. The doors 6 and 7 close into the recession 41 which is shown in the view of FIG. 7. The neck of the stove 49 appears to be square and is in the area of the damper assembly as shown in FIG. 4. There can be connected to neck 49 a square type stove pipe. It is contemplated that an adapter to receive a circular type stove pipe may also be connected to the neck 49.

When the unit 1 is used in a fireplace that already has a chimney, what with the panels circumscribing the opening in the fireplace, it is unnecessary to employ a stove pipe and the smoke exiting from the damper assembly at the neck 49 will rise into the chimney and will flow into the outside air. However, if the unit 1 is to be used as a separate heating unit rather than as a fireplace unit, the neck 49 is adaptable to receive a stove pipe which can be connected to a chimney at a distant point.

In operation, the unit or stove 1 is placed into the cavity 5 of the fireplace so that the panels 2, 3, and 4 overlay the bricks or front wall 11 of the fireplace. The positioning of the panels 2, 3, and 4 are secured by the screws 61 in the flanges 38. The panels 2, 3, and 4 conceal the hearth of the fireplace that is not displaced by the stove 1. See FIG. 1. The connection of each panel to the other, as shown in FIG. 15, is by merely turning the screws 61 in the openings in the flanges 38. The panels are then placed over the openings 35 shown in FIG. 3 for the side panels 2 and 4 and the openings 26 at the top of the unit. If the stove is in a shallow fireplace, the panels will be secured into the openings 26 and 35 nearest the rear of the unit or stove 1. If the depth of the fireplace hearth is deep and large, the openings 35 and 26 nearest the front of the unit 1 are employed. If the hearth is shallow, more of the stove 1 will extend out from the fireplace wall 11 and conversely, if it is deep, the face of the stove 1 will be even with the surfaces of the panels 2, 3, and 4.

Once the unit 1 has been set up with the panels, wood or other combustible material is placed inside the hearth behind the doors 6 and 7 of the unit 1. The doors 6 and 7 open on the hinge assemblies aforedescribed in FIGS. 17 and 18 by pulling on the handles 17. Once the fire is started, the doors 6 and 7 are closed. The amount of air into the fire box behind the doors 6 and 7 is controlled by sliding the knob 44 which permits the flow of air into the fire box behind the doors 6 and 7. If the fire is to be put out, the knobs can be moved to cut off the flow of air and smother the fire.

The rod damper control 57 is rotated to control the amount of gases and smoke exiting from the fire box. The fire can also be smothered by closing the damper 57 by rotating it to a closed position. Fee FIGS. 2, 4, 6, and 14. When the unit 1 is not in use, the damper control 57 should be closed to prevent rodents, animals, insects from entering from the chimney area.

When the shutter 43 is open and when the damper 31 is open, the fire will be burning at optimum. The cool air will follow the flow of the arrow 19 through the outer sleeve around the fire box. It wil be heated. Because of the reduced cross-section in the outer sleeve as previously described, the flow of warm air from the air exits at 18 will be with great velocity. The cycle will repeat itself so long as the fire burns in the unit.

It is contemplated that this unit can operate independently of a fireplace and can be used as a stove. The panels 2, 3, and 4 can be left disassembled and a stove pipe can be connected to the neck 49 by an adapter arrangement. The only qualification would be to place the unit 1 off the floor with insulators so that the hot metal from the unit 1 will not scorch the floor or create a fire hazard.

For clarification, the damper control assembly is referred to as 31 which can be seen in the view of FIG. 2 which comprises the components hereinbefore described. It should not be confused with the damper plate 59. There is a control damper rod spring 40 which biases the rotatable position of the rod 27 to maintain it in a fixed position. In the event that the spring 40 was not employed, the weight of the damper 59 would cause the rod 27 to rotate since the rod 27 is moveably mounted in the openings 55 and 56 in the neck 49. In the view of FIG. 14, the spring 40 is shown in partial cross-section. There is a threaded portion 65 beneath the space washer 72. This maintains the spring 40 on the threads 58 in a fixed position between the washer 64.

Reference is now made to the view of FIG. 4. The rear facade is indicated by the numeral 66. This is also shown in the view of FIG. 6.

I claim:

1. A unit for generating hot air to circulate in a room comprising of: a heat chamber, two borosilicate glass doors adapted to contract and expand from the heat, located in the front of the unit, hinge means adapted to contract and expand from the heat generated in the heat chamber mounting said doors on the front of the heat chamber, an outer enclosed sleeve duct means located near the top and rear thereof whereby the velocity of the flow of air is caused to increase, openings below the heat chamber at the base of the unit and below the doors for permitting air to enter said outer enclosed sleeve duct, an opening in the top of said unit above the heat chamber for permitting heated air to flow from said outer sleeve duct means, a reduced cross-section in said sleeve duct means that causes the heated air to flow at a high velocity, means in the front of the unit for controlling the flow of air to the heat chamber, means in the front of the unit for controlling the flow of gases and smoke from the heat chamber, sheet metal screws, panel connecting means on the top of the unit above the duct means and on the sides of the unit outside the duct means, said panel connecting means comprising of a plurality of openings in the outer surfaces of said unit adapted to receive the said sheet metal screws, each of said openings at the top and the sides thereof and being aligned equally distant from the front of the unit so that the openings in the top are aligned with the openings in the sides, flat panels, said flat panels having flanges at right angles to said panels, said flanges having openings, said flanges adapted to rest on said openings in the unit at the top and sides thereof and adapted to align with the openings at the top and the sides of the unit aforesaid in predetermined positions, whereby sheet metal screws may secure said panels in the same plane whereby the area behind the said panels is hidden from view and whereby if the fireplace is small or large, the panels can be positioned in abutment with the face of the fireplace.

2. A unit for generating hot air to circulate in a room as described in claim 1 wherein the means in the front of the unit for controlling the flow of gases and smoke from the heat chamber comprises an L-shaped rod, a vertical neck extending from the top of the heat chamber, said neck having a geometrical shape with openings therein whereby the said rod passes therethrough, means for securing the end of the rod at the outside of said neck, a damper plate mounted on said rod and of the same geometrical shape as said neck whereby when said rod is rotated, the damper plate fits snugly into said neck closing off the neck from the heat chamber, said L-shaped rod having the vertical portion extending outwardly from the front of the unit whereby the vertical portion of the L-shaped rod acts as a handle to rotate the rod, and a spring means for maintaining the position of the rod stationary.

* * * * *